US007284767B2

(12) United States Patent
Himmetsberger et al.

(10) Patent No.: US 7,284,767 B2
(45) Date of Patent: Oct. 23, 2007

(54) ARRANGEMENT FOR A SKI BINDING WHICH CAN BE POSITIONED ON A SKI

(75) Inventors: Alois Himmetsberger, Vienna (AT); Gernot Jahnel, Katzelsdorf/Eichenbüchl (AT); Manfred Baumgartner, Lichtenwörth (AT); Karl Stritzl, Vienna (AT); Hubert Würthner, Hainburg (AT)

(73) Assignee: Tyrolia Technology GmbH, Schwechat (AT)

( * ) Notice: Subject to any disclaimer, the term of this patent is extended or adjusted under 35 U.S.C. 154(b) by 58 days.

(21) Appl. No.: 10/496,632

(22) PCT Filed: Nov. 21, 2002

(86) PCT No.: PCT/EP02/13077

§ 371 (c)(1),
(2), (4) Date: Jan. 27, 2005

(87) PCT Pub. No.: WO03/043707

PCT Pub. Date: May 30, 2003

(65) Prior Publication Data

US 2005/0116444 A1 Jun. 2, 2005

(30) Foreign Application Priority Data

Nov. 23, 2001 (EP) ..... 01127933

(51) Int. Cl.
*A63C 9/00* (2006.01)

(52) U.S. Cl. ..... 280/617; 280/633

(58) Field of Classification Search ..... 280/616, 280/617, 618, 633, 607

See application file for complete search history.

(56) References Cited

U.S. PATENT DOCUMENTS

| | | | | |
|---|---|---|---|---|
| 3,790,186 | A | 2/1974 | Kanno | |
| 4,955,633 | A * | 9/1990 | Stritzl et al. | 280/633 |
| 5,040,819 | A * | 8/1991 | Horn | 280/618 |
| 5,211,417 | A | 5/1993 | Klaus et al. | |
| 5,344,178 | A * | 9/1994 | Rohrmoser | 280/617 |
| 5,480,175 | A * | 1/1996 | Astier et al. | 280/607 |
| 5,732,968 | A * | 3/1998 | Wladar et al. | 280/633 |
| 5,735,541 | A * | 4/1998 | Fritschi et al. | 280/617 |
| 5,975,555 | A * | 11/1999 | Lehner et al. | 280/618 |
| 6,092,829 | A * | 7/2000 | Mercier | 280/617 |
| 6,315,318 | B1 * | 11/2001 | Caron et al. | 280/617 |
| 6,513,826 | B1 * | 2/2003 | Hangl | 280/602 |
| 6,679,514 | B2 * | 1/2004 | Luitz et al. | 280/607 |
| 6,779,810 | B1 * | 8/2004 | Mangold | 280/634 |

* cited by examiner

FOREIGN PATENT DOCUMENTS

EP 1 181 959 2/2002

*Primary Examiner*—Christopher Bottorff
(74) *Attorney, Agent, or Firm*—Flynn, Thiel, Boutell & Tanis, P.C.

(57) ABSTRACT

The invention relates to an arrangement for a ski binding which can be positioned on a ski, the binding including two parts: a front jaw and a heel holder which can be moved in a sliding manner in the longitudinal direction of the ski in guiding mechanisms which are fixed to the ski, and are connected by a connecting element extending in the longitudinal direction of the ski. The position of one of the parts of the ski binding can be adjusted in relation to the connecting element, and the connecting element can be fixed in relation to the ski. The mutual position of the front jaw and the heel holder can be self-adjusted and fixed on the connecting element in such a way that the front jaw and the heel holder form, together with the connecting element, a pre-assembled unit which is separate from the ski, and which can be slid along the guiding mechanisms which are fixed to the ski.

16 Claims, 5 Drawing Sheets

ARRANGEMENT FOR A SKI BINDING WHICH CAN BE POSITIONED ON A SKI

FIELD OF THE INVENTION

The invention relates to an arrangement for a ski binding, which can be positioned on a ski, comprising two ski-binding parts, a front jaw and a heel holder, which can be moved in a sliding manner in longitudinal direction of the ski in ski-fixed guiding mechanisms, and are connected by means of a connecting element extending in longitudinal direction of the ski, whereby at least the position of one of the ski-binding parts can be adjusted relative to the connecting element and the connecting element can be fixed relative to the ski.

BACKGROUND OF THE INVENTION

Such an arrangement, which enables an adaptation of the ski binding to varying ski-shoe sizes and at the same time assures that, when traveling through depressions or the like, an essentially unhindered bending of the ski is possible, is known, for example, from the AT-B-389 453. The connecting element, which extends without guidance between the front jaw and the heel holder can be fixed by means of a receiving means on a locking element, which is provided on the ski-fixed guide rail for the front jaw. The connecting element designed as a metal band can thus be adjusted relative to the ski-fixed guide rail receiving the front jaw. The locking of the metal band on the guide rail occurs with the help of a rotatably supported bolt, which engages one of the holes of a row of holes in the metal band. When the metal band is supposed to be adjusted relative to the guide rail, then the bolt is turned by means of a screw driver so that the end area of the metal band can be lifted off from the bolt. The metal band is now adjusted to the desired distance of the heel holder from the front jaw, the chosen hole is thereafter placed onto the bolt and the bolt is again turned. For a fine adjustment of the distance between the front jaw and the heel holder, an adjusting detent of the heel holder is released relative to its guide rail, the heel holder is moved into the desired position in the guide rail, and is again locked. The known arrangement is thus complicated and not user friendly with respect to its handling.

SUMMARY OF THE INVENTION

The basic purpose of the invention is to design an arrangement of the above-mentioned type in such a manner that it is user friendly to operate and guarantees, while maintaining the elastic deformation characteristics of the ski, a simple adaptation of the ski binding to varying shoe sizes.

The set purpose is attained according to the invention by the mutual position of the front jaw and heel holder being able to be self-adjusted and fixed on the connecting element, so that the front jaw and the heel holder form, together with the connecting element, a pre-assembled unit, which is separate from the ski, and which can be moved onto the ski-fixed guiding mechanisms.

The invention enables a very simple and very comfortable handling of the ski binding during adjustment of the same to varying ski-shoe sizes and during installation of the ski. Particularly user friendly is the handling of the inventive arrangement most of all because the adjustment of the mutual distance between the two ski-binding parts can occur separate from the ski, the in this manner "pre-assembled" unit is merely to be moved onto the ski-fixed guiding mechanisms, and the connecting element is subsequently fixed.

The connecting element can according to a particularly preferred embodiment of the invention be fixed with its central area relative to or on the ski. The fixation of the pre-assembled unit occurs therefore at an easily accessible point. The fastening elements, which are needed for this purpose and which are not to be integrated into the area of the ski-binding parts, can thus be designed simply and advantageously.

The fixation of the pre-assembled unit relative to the ski occurs in a preferred embodiment of the invention by means of at least one fastening element, for example a screw, which connects the connecting element to a connecting plate supported on the ski.

It is thereby possible in order to fasten the fastening element to provide several fastening points spaced from one another in longitudinal direction of the ski so that the relative position of the ski binding can be adjusted in longitudinal direction of the ski depending on the skiing ability of the user.

The parts of the inventive arrangement, which parts are to be arranged on the ski according to a preferred embodiment, are supposed to have an advantageous and simple design. It is advantageous in this connection when the plate connectable to the connecting element is held between and by two plates following in longitudinal direction of the ski, which plates have the guiding mechanisms for receiving the pre-assembled unit.

The system of plates and ski binding is supposed to, in as far as it is necessary, react flexibly to the varying loads during skiing. This is achieved or supported, for example, by the plate, which can be connected to the connecting element being limitedly tiltably supported relative to the one plate following in longitudinal direction of the ski, and being limitedly longitudinally movably supported relative to the other plate following in longitudinal direction of the ski.

A fixed and safe connection of the pre-assembled unit of ski binding and connecting element relative to the ski can be achieved by simple measures and also by a simple operation. In this regard a preferred embodiment provides that a fastening part is inserted or housed in the connecting plate, which fastening part has the fastening points for the fastening element, and that a receiving element for the fastening element is arranged, for example snapped, on the upper side of the connecting element.

An inventively designed arrangement can advantageously provide that the ski together with the plates forms one pre-assembled unit, which is delivered in this form to the sporting-goods commerce. Thus the dealer does not have to deal with the complicated and time-consuming installation of binding parts on the ski.

An alternative embodiment has also this advantage, where the guiding mechanisms and/or the fastening points for the unit of ski-binding parts and connecting element, which unit can be pre-assembled, are integrated into the ski during the manufacture of the ski. This offers the manufacturer of the ski the possibility to be able to adjust ski and binding at an optimum to one another, however, on the other hand it is related to a certain amount of work during the manufacture of the ski.

In order to guarantee a thrust bearing pressure when the ski shoe is inserted, it is provided that the connecting element can be fastened at least in the area of one of the ski-binding parts on a locking part, relative to which the ski-binding part can be moved rearward on its ski-fixed guiding mechanism against the force of at least one spring so that, when a ski shoe is inserted into the binding, a thrust bearing pressure can be built up.

The position of the ski-binding part can according to a preferred embodiment of the invention be adjusted and changed over a limited area relative to the locking part. This enables a certain re-adjustment of the position of the ski-binding part when the binding is already mounted on the ski, and it is also possible to correspondingly correct the thrust bearing pressure should same be too great or too low.

The parts of the mechanism for the re-adjustment are arranged and designed in a simple and operatively safe manner when the thrust spring(s) can be supported with their one end on a ski-binding-fixed part, for example a base plate, and with their other end on or in a spring holder, the position of which spring holder can be adjusted and fixed limitedly in longitudinal direction on the locking part.

The locking part, which the connecting element engages in order to adjust the binding to the respective shoe size, should enable in a simple manner the locking of the connecting element. It is advantageous in this connection when the locking part is a plate-shaped part and is arranged limitedly longitudinally movably on a support plate, on which the further ski-binding parts, in particular the base plate, are fastened, and which is movable on the ski-fixed guiding mechanism, and when the locking part has means for locking the connecting element, for example two tooth systems defined by a recess, which tooth systems are accessible from the underside of the support plate.

To adjust the spring holder, same is preferably coupled to an adjusting detent, which has locking elements, which can mate with the locking part itself in varying positions.

The invention also relates to a ski and a ski binding, which are provided with an inventively designed arrangement.

BRIEF DESCRIPTION OF THE DRAWINGS

Further characteristics, advantages and details of the invention will now be described in greater detail in connection with the drawings, which illustrate one exemplary embodiment. The drawing figures are simplified schematic illustrations in which.

DETAILED DESCRIPTION OF THE INVENTION

The terms "longitudinal direction", "longitudinally movable" or "longitudinally slidable" refer in the following description and the patent claims to a direction parallel to the longitudinal direction of the ski, the term "front" refers to a direction in which the toe ski-binding part is positioned, the term "rearward" refers to the direction in which the heel ski-binding part is positioned.

Figure 1:
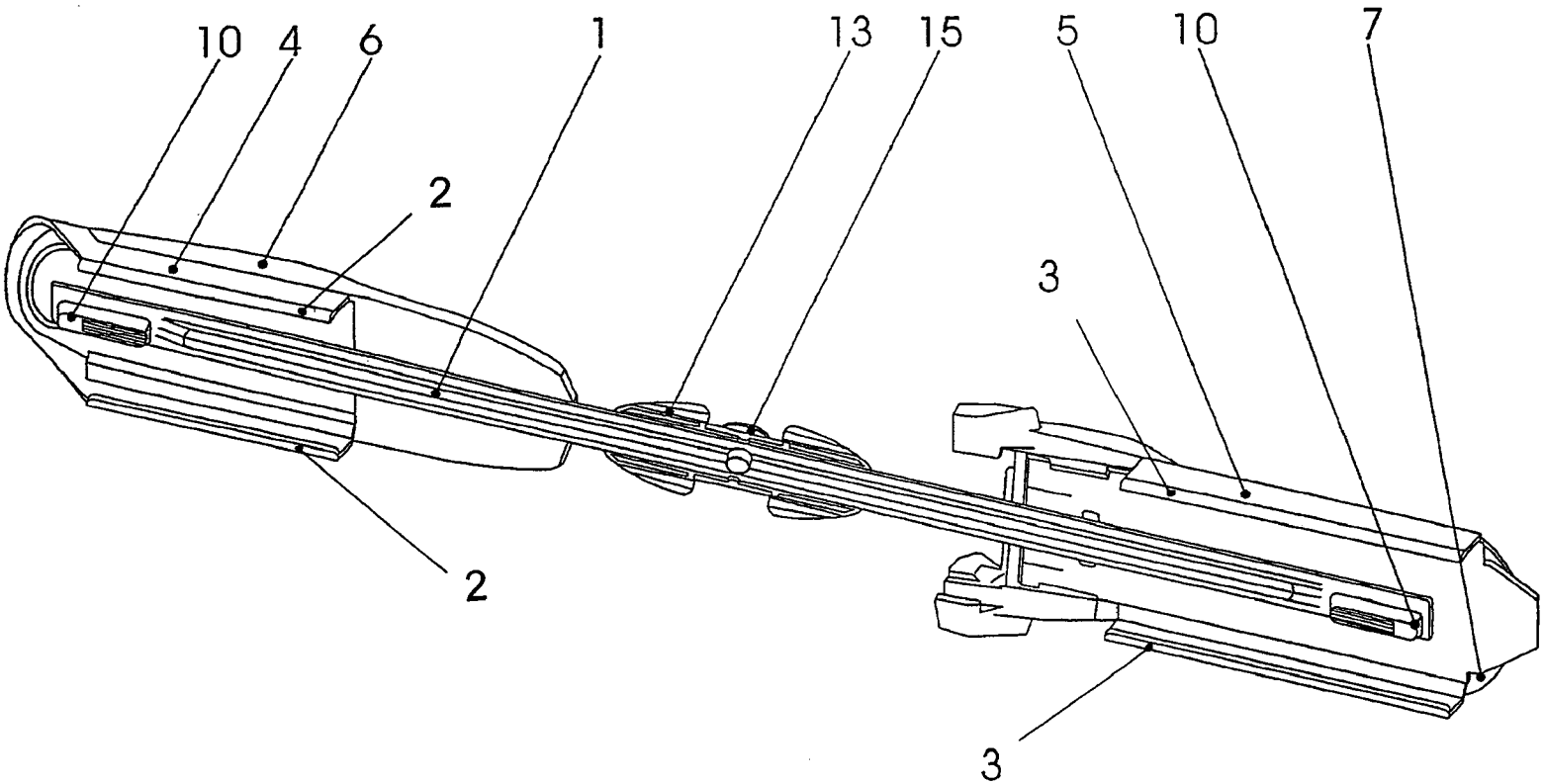
FIG. 1 is a view of the underside of premounted parts of an inventively designed arrangement.

The inventive arrangement is provided for fixing or positioning of a ski binding on a ski, which ski binding has a front jaw and a heel holder. The front jaw and the heel holder can be designed in any desired and in particular in the usual manner so that FIG. 1 merely illustrates a base plate 6 of the front jaw and a base plate 7 of the heel holder. The base plates 6, 7 are arranged on support plates 4, 5 or are connected to the support plates 4, 5. Both the support plate 4 provided for the base plate 6 of the front jaw and also the support plate 5 provided for the base plate 7 of the heel holder 5 are designed in the form of L-shaped guide bars 2, 3 on their two edge areas extending in longitudinal direction of the ski in order to enable a moving of the support plates 4, 5 onto plates 17, 18 arranged on the ski, the design of which plates 17, 18 will be discussed later on.

An important part of the inventive arrangement is a connecting element 1 which is designed in particular as a metal band, and which connects the support plate 4 of the front jaw to the support plate 5 of the heel holder. The mechanisms creating this connection are designed such that the mutual distance between the support plate 4 of the front jaw and the support plate 5 of the heel holder and thus the mutual distance between the ski-binding parts can be selected and adjusted.

Figure 2:
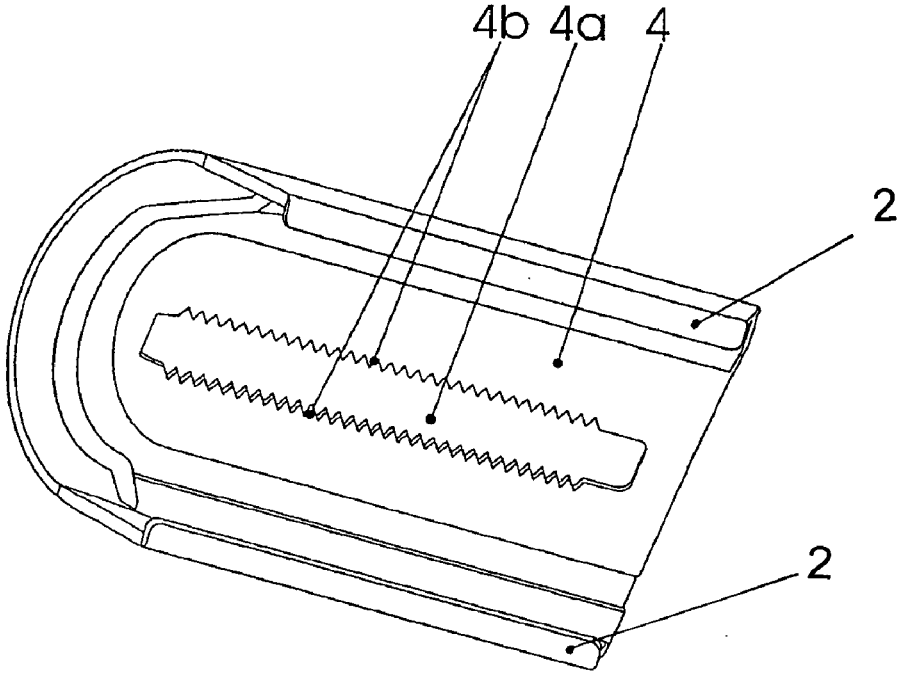
FIG. 2 illustrates details of an embodiment of a locking mechanism.
Figure 2:
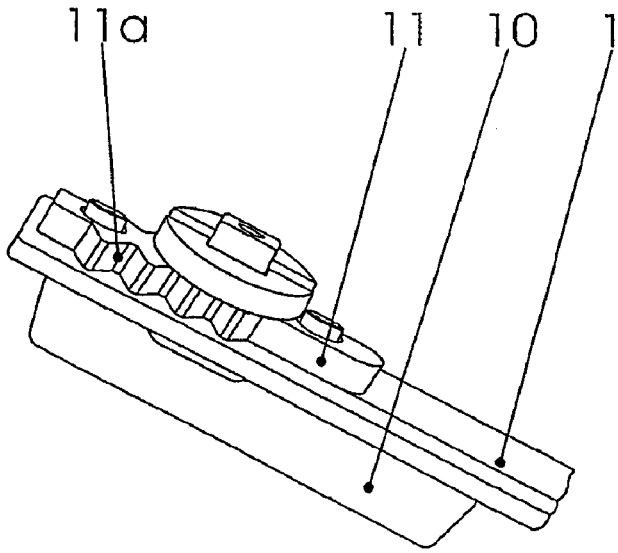

FIG. 2 shows one exemplary embodiment of a suitable locking mechanism. The illustrated locking mechanism is the one for the support plate 4 of the front jaw, the locking mechanism provided in the area of the support plate 5 of the heel holder can have the same design. As shown in FIG. 2, a recess 4*a* extending in longitudinal direction is constructed centrally in the support plate 4. The edges which define the recess 4*a* in longitudinal direction and which are aligned parallel to one another, each have a tooth system 4*b*. A locking element 11, which has counter tooth systems 11*a* and can be operated through a, lever 10, is movably arranged on the end area of the connecting element 1. The connecting element 1 can be moved, during a suitable positioning of the locking element 11, into the central recess 4*a* of the support plate 4. As soon as the desired position has been reached, a mating of the counter tooth systems 11*a* of the locking element 11 with the tooth systems 4*a* and thus a fixed connection of the support plate 4 to the connecting element 1 is created by rotating the lever 10. Not illustrated dials, which are mounted on the connecting element 1, enable an exact adjustment of the mutual distance of the ski-binding parts to the length of the respective ski shoe.

A receiving element 13 for a fastening screw 15 is arranged in the central area of the connecting element 1 on its upper side. The receiving element 13 and the connecting element 1 are each provided with a receiving hole for the screw 15. The receiving element 13, which consists in particular of plastic, can be snapped onto the connecting element, the associated designs of the receiving element 13 and of the connecting element 1 are familiar to the man skilled in the art.

Figure 3:
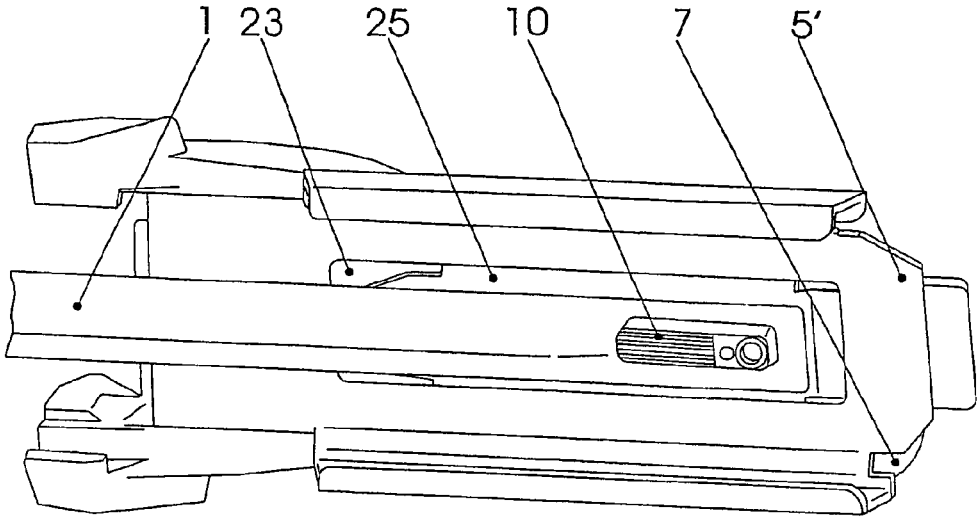
FIG. 3 is a view of the underside of parts provided in the area of a rearward binding part.
Figure 4A:
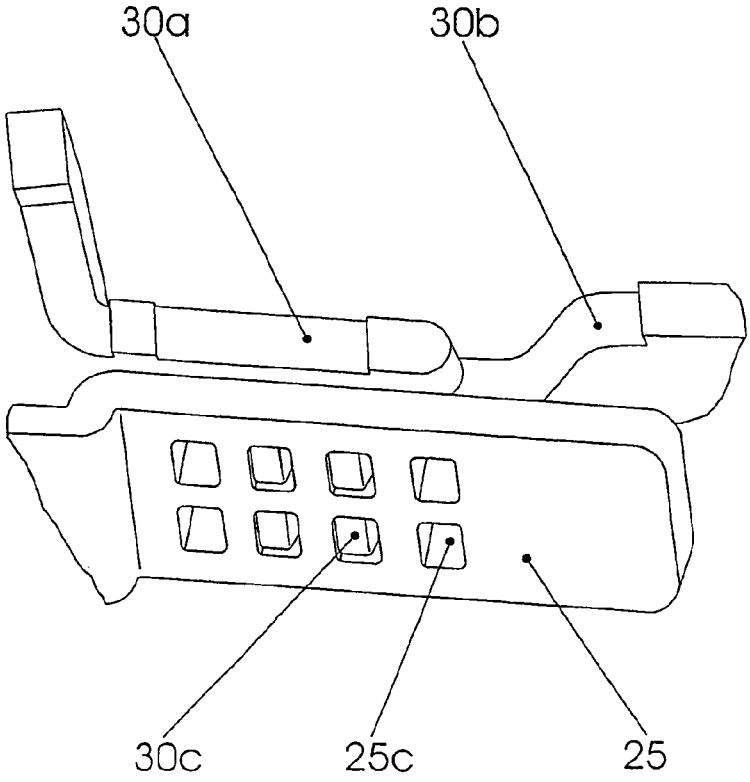
FIG. 4*a* is a detail of a locking structure.
Figure 4:
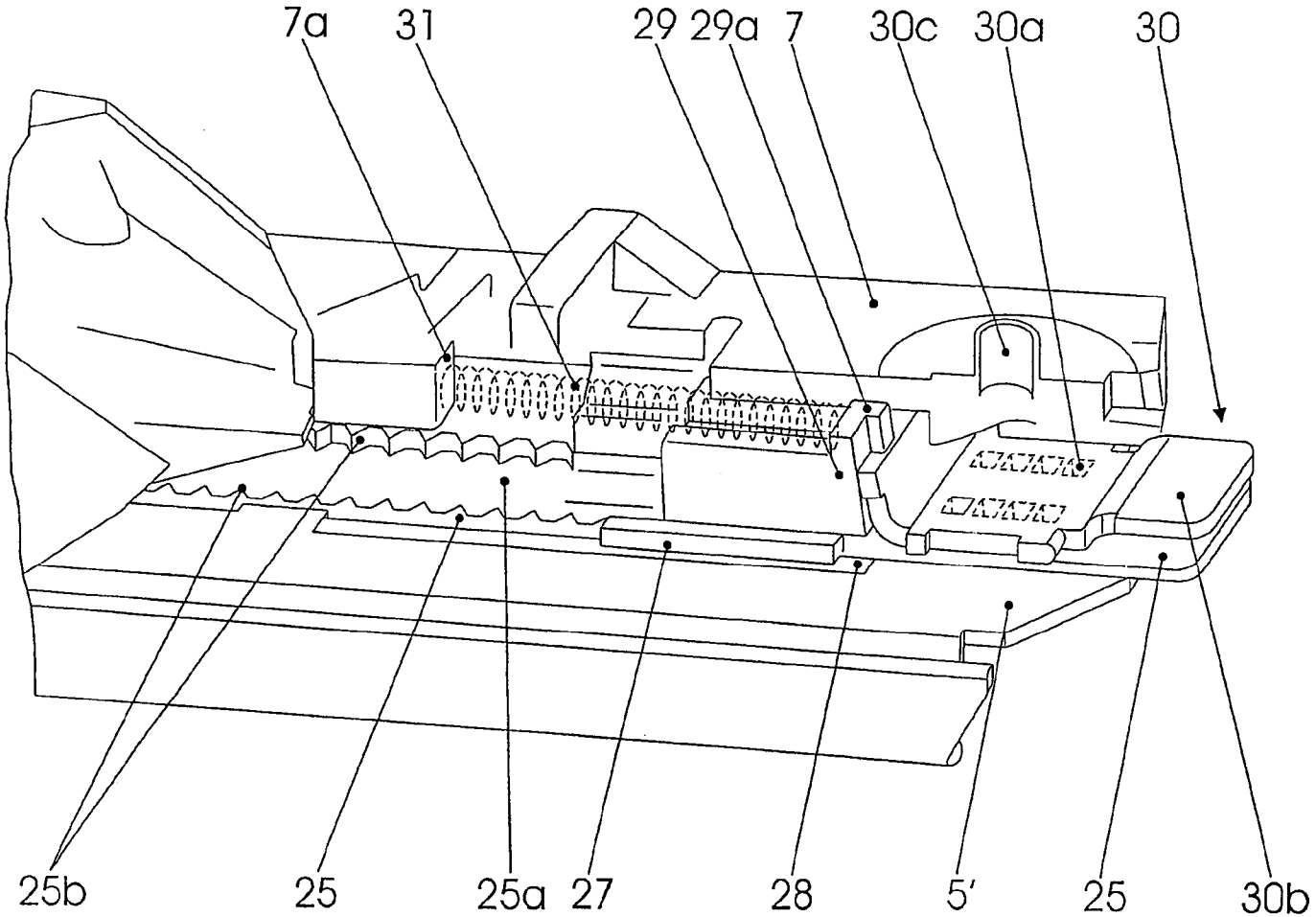
FIG. 4 is an isometric view of some parts in the area of the rearward binding part.

FIGS. 3 and 4 illustrate a further embodiment of the type of the connection of the connecting element 1 in the area of the heel holder. The support plate 5' on which, as has already been mentioned, the base plate 7 of the heel holder is fastened, is here provided centrally with a recess 23 extending in longitudinal direction of the support plate 5'. An elongated locking part 25 is inserted from the upper side of the support plate 5' into the recess 23, which locking part 25, as is shown in FIG. 4, has a central recess 25*a*, the extent of which corresponds with the extent of the recess 23 in the support plate 5', and the longitudinal edges of which have tooth systems 25*b*. The central recess 25*a* and the tooth systems 25*b* defining their longitudinal edges correspond with the recess 4*a* illustrated in FIG. 2 and the tooth systems 4*b*.

A relatively large portion of the base plate 7, which covers the further illustrated parts, is left out or broken away in FIG. 4 in order to permit to recognize the arrangement and design of the parts otherwise covered up by the base plate 7.

The locking part 25 has a lateral extending flange 27 in the area of each of its outer longitudinal edges, of which flanges one is shown in FIG. 4. The lateral flanges 27 are supported on sliding surfaces 28 of the support plate 5' so that the locking part 25 can be longitudinally movable or slidable in longitudinal direction relative to the base plate 7 and to the support plate 5' connected to the base plate. Thus also the further parts of the not illustrated heel holder, which parts are arranged on the base plate 7 or are connected to the base plate, are together with the support plate 5' longitudinally movable relative to the locking part 25, as will be described in greater detail later on. The extent of the longitudinal mobility is limited by not illustrated stops constructed on both sides on the underside of the base plate 7.

FIG. 3 illustrates the connecting element 1 in its position locked on the locking part 25, in which position a locking-element, which is not visible, and is constructed on this end area of the connecting element 1 corresponding to the design according to FIG. 2, and which can be operated by the lever 10, engages with its, here not visible, locking teeth the two tooth systems 25*b*.

FIG. 4 shows that a spring holder 29, which is only partially illustrated, is inserted from the upper side into the locking part 25 such that it is longitudinally movable relative to the locking part 25. The spring holder 29, however, is in the position illustrated in FIG. 4 in a position fixed on the locking part 25. The spring holder 29 forms a type of a housing for the arrangement of thrust springs 31 and an abutment for two thrust springs 31 designed as compression springs. FIG. 4 indicates thereby only one of the thrust springs 31 in broken lines. The thrust spring 31 is housed in a receiving recess of the spring holder 29 and is supported at its one end on the backwall 29*a* of the spring holder 29. The thrust springs 31 are supported at their other end on stop surfaces 7*a* or the like constructed on the outer base plate 7. The spring holder 29 is coupled at the outer face area of the wall 29*a* of the spring holder 29 to an adjusting detent 30, which has a small detent plate 30*a* and following same an operating element 30 projecting beyond the rearward end of the heel holder or the base plate 7, which operating element 30*b* enables a manual operation of the adjusting detent 30. As is in particular shown in FIG. 4*a*, several pairs of locking projections 30*c* are constructed on the underside of the small detent plates 30*a*, which pairs of locking projections 30*c* can engage locking openings 25*c* also arranged in pairs on the rearward end area of the locking part 25.

FIG. 4 shows the locked position of the adjusting detent 30, in which the thrust springs 31 apply a moment of force based on their arrangement, which moment of force presses the locking detent 30 into this locked position. The type of coupling of the adjusting detent 30 to the spring holder 29 is designed such that the adjusting detent 30, without coming loose from the spring holder 29, can be lifted by means of the operating element 30*b* so high that its locking projections 30*c* can disengage from the locking openings 25*c* of the locking part 25. The base plate 7 of the heel holder, which covers and extends over the spring holder 29, holds the spring holder from above, however, can be moved together with the further parts of the heel holder and of the support plate 5' limited in longitudinal direction relative to the spring holder 29.

Figure 5:
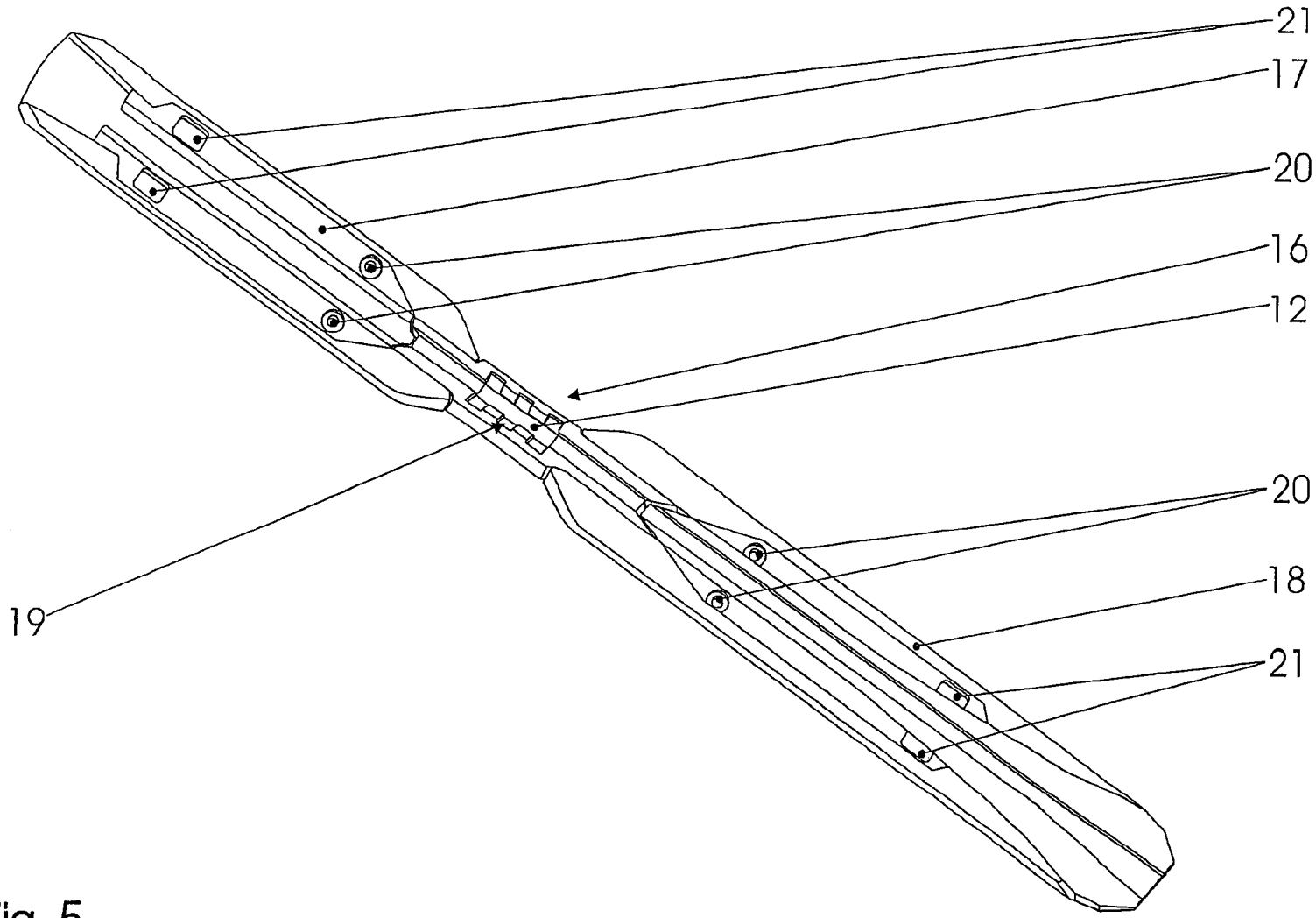
FIG. 5 is a top view of parts of the arrangement, which parts are to be arranged on the ski.

The plates 16, 17, 18 arranged on the not illustrated ski are shown in FIG. 5. The connecting plate 16, which is in the center and is designed narrow by comparison, is held and covered in the connecting area to the plates 17, 18 each by two tongue-like shoulders. The design of the connecting areas of the connecting plate 16 to the plates 17, 18 is such that the connecting plate 16 can be tilted limitedly relative to the one plate 17, 18 and can be longitudinally movable limitedly relative to the other plate 17, 18. An elongated fastening part 12 is integrated, for example inserted from below, centrally into the connecting plate 16. The fastening part 12 has a number of receiving holes 12*a*, in particular three holes 12*a*, for receiving the fastening screw 15. The receiving holes 12*a* are aligned, in particular equally spaced, in longitudinal direction of the guide plate 14 and are accessible from the upper side of the connecting plate 16 through a slotted opening 19.

The lateral plates 17, 18 are fastened on the not illustrated ski by means of not illustrated screws. The illustrated embodiment requires two pairs of screws each to fasten each plate 17, 18. FIG. 3 shows the fastening holes 20, 21, which are arranged in pairs. The fastening holes 20 are provided near the connecting plate 16 and are constructed for the usual quick fastening. The further pairs of fastening holes 21, which further pairs are constructed on the front or on the rear end area of the plates 17, 18, are slotted holes. The plates 17, 18 are held on the ski by the screws, which-are approximately centrally positioned in the slotted holes, however, a certain mobility of the plates 17, 18 relative to the ski is permitted. The side edges of the plates 17, 18, which side edges extend in longitudinal direction, form guideways for the guiding bars 2, 3 of the support plates 4, 5.

The ski is preferably already at the ski manufacturer provided with the plates 16, 17, 18 and is thus delivered together with them. This has also the advantage that the design of the plates 16, 17, 18 can be adjusted to the design of the ski. As an alternative to separate plates 16, 17, 18, however, it is also possible for the ski manufacturer to integrate the guideways for the support plates 4, 5 and the connecting point for the connecting element 1 during construction of the ski or into the construction of the ski. The desired and needed mobility of the ski is assured by using suitable materials and in cooperation with the connecting element 1.

The following description shows how easily and very comfortably the inventive arrangement can be handled.

In order to mount the ski binding on the ski the two ski-binding parts, heel holder and front jaw, which are provided on the support plates 4, 5, are coupled with one another through the connecting element 1. First the mutual distance between the front jaw and the heel holder or the mutual distance between the two support plates 4, 5 is thereby adjusted corresponding to the length of the ski shoe to be used by operating the locking mechanisms. Thus the two ski-binding parts form together with the connecting element 1 a preassembled unit, which is now moved over its guiding bars 2, 3 onto the plates 17, 18, which are already fastened on the ski. When the screw holes of the connecting element 1 and of the receiving element 13 are in alignment with one of the fastening holes 12*a* of the fastening part 12, the fastening screw 15 is fixedly screwed to the fastening part 12 and the connecting element 1 is thus connected to the connecting plate 16. The fastening screw 15 does thereby not create a connection to the ski. By choosing one of the three fastening holes 12*a* in the fastening part 12, the relative position of the ski binding can be adjusted in longitudinal direction of the ski, whether slightly farther to the front or slightly farther to the back, in particular in dependency of the skiing ability of the user.

In order to adjust the distance between the two ski-binding parts to a ski shoe of a different length, the central fastening is released by unscrewing the fastening screw 15, the unit of ski-binding parts and connecting element 1 is moved from the guide plate 14 and the mutual distance between the two ski-binding parts is changed in the already described manner. The unit of ski-binding parts and connecting element 1 is thereafter, as has already been described, again mounted on the ski.

The embodiment illustrated in FIG. 4 provides that during the insertion of the ski shoe into the binding mounted on the ski a thrust bearing pressure is guaranteed by the thrust springs 31 since the ski shoe during stepping in moves the heel holder together with the support plate 5' slightly backward relative to the plate 18 fastened on the ski and against the force of the thrust springs 29. The magnitude of the thrust bearing pressure can thereby be read on an indicator coupled to the spring path from outside using a suitable dial. If now after the mounting of the binding on the ski the check of the position of the ski-binding parts through insertion of the respective ski shoe results in a compression of the thrust springs 31, which is too great or too small, then it is possible in a simple manner to carry out a suitable adjustment by releasing the locking of the locking detent to the locking part 25 by lifting the operating element 30*b*, by adjusting the correct position by moving the heel holder together with the support plate 5' relative to the ski-fixed plate 18, and by again locking the adjusting detent 30 in the desired position. It is therefore not necessary for this readjustment to again remove or demount the unit of ski-binding parts and connecting element from the ski.

The inventive arrangement makes a bending of the ski, which is advantageous for a safe release of the ski binding when skiing through depressions and the like, possible and thus prevents an undesired stiffening of the ski in the area of the ski binding.

Not illustrated and described are diverse covering elements, which cover the plates 17, 18, in particular in the area of the fastening holes 20, 21 and the receiving element in the central area of the connecting element 1, and also stepping plates and the like, which can be coupled to the ski-binding parts.

The invention claimed is:

1. An arrangement for a ski binding, which can be positioned on a ski, comprising two ski-binding parts, a front jaw and a heel holder, which can be moved in a sliding manner in longitudinal direction of the ski in ski-fixed guiding mechanisms, and are connected by means of a connecting element in the form of a band extending in longitudinal direction of the ski, whereby at least the position of one of the ski-binding parts can be adjusted relative to the connecting element and the connecting element can be fixed relative to the ski, wherein the mutual position of front jaw and heel holder can be self-adjusted and fixed on the connecting element, so that the front jaw and the heel holder form, together with the connecting element, a pre-assembled unit, which is separate from the ski, and which can be moved onto the ski-fixed guiding mechanisms, wherein the fixation of the pre-assembled unit relative to the ski occurs by means of at least one fastening element which connects the connecting element to a connecting plate supported for limited mobility on the ski.

2. The arrangement according to claim 1, wherein the connecting element can be fixed with a central area relative to or on the ski.

3. The arrangement according to claim 1, wherein several fastening points, which are spaced from one another in longitudinal direction of the ski, are provided for the fastening of the at least one fastening element.

4. The arrangement according to claim 1, wherein the connecting plate is held between and by two plates following in longitudinal direction of the ski, said two plates having ski-fixed guideways for receiving the pre-assembled unit.

5. The arrangement according to claim 1, further comprising two plates, wherein the connecting plate is limitedly tiltably supported relative to one of said two plates, following in longitudinal direction of the ski, and is limitedly longitudinally movably supported relative to the other of said two plates following in longitudinal direction of the ski.

6. The arrangement according to claim 1, wherein a fastening part is inserted or housed in the connecting plate, which fastening part includes fastening points for the fastening element.

7. The arrangement according to claim 1, wherein a receiving element for the fastening element is arranged on the upper side of the connecting element.

8. The arrangement according to claim 4, wherein the ski, together with the connecting plate and the two plates, forms a pre-assembled unit.

9. The arrangement according to claim 4, wherein the connecting element can be fastened to a locking part at least in the area of one of the ski-binding parts, relative to which locking part the ski-binding part can be moved rearward on the ski-fixed guideway against the force of at least one spring, so that when a ski shoe is inserted into the binding, a thrust bearing pressure can be built up.

10. The arrangement according to claim 9, wherein a position of the ski-binding part can be adjusted and changed over a limited area relative to the locking part.

11. The arrangement according to claim 9, wherein at least one thrust spring can be supported with a first end on a ski-binding-fixed part and with a second end on or in a spring holder, the position of which spring holder can be adjusted and fixed for limited movement in a longitudinal direction on the locking part.

12. The arrangement according to claim 9, wherein the locking part is an approximately plate-shaped part and is arranged limitedly longitudinally movably on a support plate, on which further ski-binding parts are fastened, and which is movable on the ski-fixed guideway.

13. The arrangement according to claim 9, wherein the locking part includes two tooth systems defined by a recess for locking of the connecting element, which tooth systems are accessible from the underside of the support plate.

14. The arrangement according to claim 9, wherein the spring holder is coupled to an adjusting detent, which has locking elements, which can mate with the locking part in varying positions.

15. The arrangement according to claim 1, wherein the ski-fixed guiding mechanisms are integrated into the ski during its manufacture.

16. An arrangement for a ski binding, which can be positioned on a ski, comprising two ski-binding parts, a front jaw and a heel holder, which can be moved in a sliding manner in longitudinal direction of the ski in ski-fixed guiding mechanisms, and are connected by means of a connecting element in the form of a band extending in longitudinal direction of the ski, whereby at least the position of one of the ski-binding parts can be adjusted relative to the band and the band can be fixed relative to the ski, wherein the mutual position of front jaw and heel holder can be self-adjusted and fixed on the band, so that the front jaw and the heel holder form, together with the band, a pre-assembled unit, which is separate from the ski, and which can be moved onto the ski-fixed guiding mechanisms, wherein the fixation of the pre-assembled unit relative to the ski occurs by means of at least one fastening element which connects the band to a connecting plate supported for limited mobility on the ski, wherein the band can be fastened to a locking part at least in the area of one of the ski-binding parts, relative to which locking part the ski-binding part can be moved rearward on the ski-fixed guiding mechanism against the force of at least one spring, so that when the ski shoe is inserted into the binding a thrust bearing pressure can be built up, and wherein the position of the ski-binding part can be adjusted and changed over a limited area relative to the locking part.

* * * * *